US005911168A

United States Patent [19]

Enserink

[11] Patent Number: 5,911,168

[45] Date of Patent: Jun. 8, 1999

[54] NECK CONNECTION FOR A STRINGED INSTRUMENT MADE IN ONE PIECE, AND METHOD FOR THE PRODUCTION THEREOF

[75] Inventor: Anton Rudolf Enserink, Wassenaar, Netherlands

[73] Assignee: Catalyst Corporate Development B.V., Delft, Netherlands

[21] Appl. No.: 08/737,790

[22] PCT Filed: May 23, 1995

[86] PCT No.: PCT/NL95/00178

§ 371 Date: Nov. 25, 1996

§ 102(e) Date: Nov. 25, 1996

[87] PCT Pub. No.: WO95/32494

PCT Pub. Date: Nov. 30, 1995

[51] Int. Cl.[6] ..... G10D 3/00

[52] U.S. Cl. ..... 84/291; 84/293; 84/267; 29/896.22; 264/136; 264/258

[58] Field of Search ..... 84/267, 290, 291, 84/293; 29/896.22, 896.2; 264/136, 258

[56] References Cited

U.S. PATENT DOCUMENTS

| | | | |
|---|---|---|---|
| 4,213,370 | 7/1980 | Jones | 84/291 |
| 4,290,336 | 9/1981 | Peavey | 84/291 |
| 4,359,923 | 11/1982 | Brunet | 84/267 |
| 4,846,039 | 7/1989 | Mosher | 84/293 |
| 4,873,907 | 10/1989 | Decker et al. . | |
| 5,054,356 | 10/1991 | Farnell, Jr. | 84/291 |
| 5,305,674 | 4/1994 | Fishman et al. | 84/291 |
| 5,313,362 | 5/1994 | Liber | 84/267 |
| 5,616,873 | 4/1997 | Fishman et al. | 84/293 |

FOREIGN PATENT DOCUMENTS

| | | |
|---|---|---|
| 54-119910 | 9/1979 | Japan . |
| 2 037 049 | 7/1980 | United Kingdom . |
| 2 045 503 | 10/1980 | United Kingdom . |

OTHER PUBLICATIONS

M. Glaskin, "Sound Ideas", *Engineering,* vol. 231, No. 6, Jun. 1991, p. 20 ACE.

N. Steinberger, "Composites give guitar a unique sound", *Machine Design,* vol. 54, No. 4, Feb. 1982, pp. 74–75.

"Innovative guitar combines carbon fibre and polyurethane", *Design Engineering,* Jun. 1985, London, England, pp. 4 and 5.

*Primary Examiner*—Stanley J. Witkowski
*Assistant Examiner*—Kim Lockett
*Attorney, Agent, or Firm*—Young & Thompson

[57] ABSTRACT

Neck connection for an method for the production of a stringed instrument, comprising at least a body (1) and a neck (2), in which both the neck (2) and the body (1) are made of plastic and the body (1) and the neck (2) are in one piece, and the neck connection comprises fiber structures (41, 42, 43) and side fiber structures (31, 32, 33; 51, 52, 53) molded into the plastic, which fiber structures (41, 42, 43) and side fiber structures (31, 32, 33; 51, 52, 53) extend both in the neck (2) and the body (1).

15 Claims, 1 Drawing Sheet

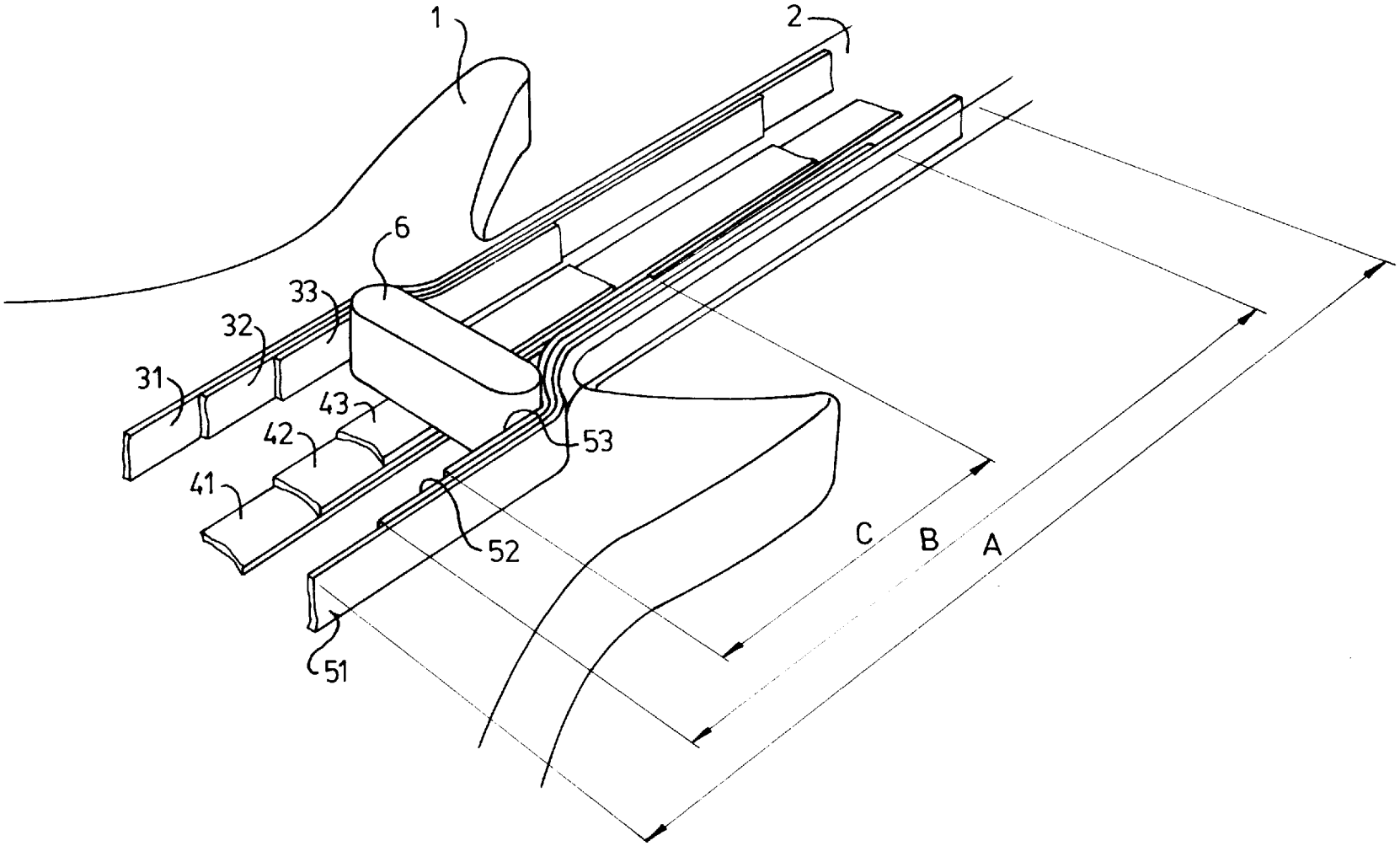
1
2
6
33
32
31
43
42
41
53
52
51
A
B
C

NECK CONNECTION FOR A STRINGED INSTRUMENT MADE IN ONE PIECE, AND METHOD FOR THE PRODUCTION THEREOF

The present invention relates to a neck connection for a stringed instrument, comprising at least a body and a neck, both the neck and the body being made of plastic.

Such a neck connection for a stringed instrument, for example an acoustic guitar, is known from U.S. Pat. No. 4,873,907. The body of the known guitar is made from an aramid mat, a layer of carbon fibres and over that a layer of silk, all of this being embedded in a gel coat. On the other hand, the neck of the known guitar is made of a foam which is covered with a woven layer, over which a decorative fabric is fixed. The neck is also embedded in a gel coat.

A disadvantage of the known neck connection is that it consists of two parts, so that two parts still have to be fixed to each other before the final neck connection is ready. This inevitably involves alignment tolerances, so that neck connections produced in this way always differ slightly from each other. Fixing together two separate parts also costs effort and money.

A stringed instrument has to meet many requirements, of which the following are the most important:

- an excellent sound, the norm being determined by standard wooden stringed instruments;
- damping characteristics which can be set during production;
- high resistance to creep deformation in the neck and in the part of the body carrying the string tension; the strings exert a permanent load in the form of a bending moment (in the case of standard electric guitars between 3 and 5 Nm) and a pressure load on the neck (between 300 and 500 Nm);
- sufficient strength in the case of peak loads of the type occurring when the instrument falls;
- very low bending of the neck and the part of the body carrying the string tension;
- low weight of the neck and the body, in order to produce the highest possible resonance frequency of the neck and to make the freedom of design as great as possible;
- the avoidance of unintended cavities in the product, in order to prevent undesirable resonances;
- there must be room for standard electromagnetic pick-up elements at predetermined positions under the strings;
- minimal use of materials which adversely affect the sound.

It is also desirable that the production should be possible in a continuous process and in series at the lowest possible cost.

It is therefore an object of the present invention to provide a neck connection in one piece which as far as possible meets the above standards for modern musical instruments, and which is suitable for use in, for example, an electric guitar.

For this purpose, the invention provides a neck connection for a stringed instrument which is characterized in that the body and the neck are in one piece and the neck connection comprises at least fibre structures and side fibre structures moulded into the plastic, which fibre structures and side fibre structures extend both in the neck and in the body.

Through the use of these measures it is possible to mould a stringed instrument in one piece, while the body and the neck of the stringed instrument can each still exhibit individual characteristics as regards weight and rigidity. In addition, such a neck connection no longer has any alignment tolerances as regards the position of the neck relative to the body. Moreover, this produces a very rigid connection between the neck and the body, based on an optimum three-point connection.

It is pointed out that in "Sound ideas", Engineering 231 (June 1991), No. 6, pp. 20–21, it is actually mentioned that injection moulding a complete guitar in one piece is possible in principle. However, only disadvantages are expected from this, because the short fibres would lower the quality of the sound. On the other hand, such a guitar could be cost-saving. In any case, the above-mentioned article does not mention any measures for producing such a guitar in one piece.

In a preferred embodiment the fibre structures and the side fibre structures are in the form of a band.

In the neck connection according to the invention provision is also made for a core, and the fibre structures and the side fibre structures can rest against the core and be positioned by it in the body. The fibre structures and side fibre structures can consequently be positioned firmly in a desired place, while moulding compound is placed in a mould, by means of which the stringed instrument is manufactured.

In one embodiment of the invention the plane of the band-shaped fibre structures lies substantially at right angles to the plane of the band-shaped side fibre structures.

In another embodiment the fibre structures comprise four bands placed on top of one another, and the side fibre structures comprise two band parts running largely parallel, each of which band parts consists of three bands placed on top of one another. In this case the fibre structures and side fibre structures preferably comprise at least one band of a first length, at least one band of a second length, and at least one band of a third length, the first, second and third lengths not being equal to one another.

The bands of the fibre structures and the side fibre structures can also be of equal width and thickness over their entire length, the width preferably being approximately 25 mm.

The bands of the fibre structures and the side fibre structures are preferably made of a unidirectional carbon fibre embedded in a laminating resin. Said carbon fibres can simply be laid parallel to the hypothetical force lines in the neck connection, so that they lie in the correct direction. Moreover, they can be laid in the correct place, namely as outer fibres in a thin-walled tubular profile. Finally, the cross-section of the fibres, viewed in a direction at right angles to the force lines, is simple to adapt to the bending moment line.

The plastic is, for example, thermosetting resin filled with hollow glass beads. This means that the major part of the material used can remain lightweight and the structure can have properties very closely corresponding to those of wood. The material also has reasonable flexibility and compression strength and has a pleasant damping character.

In a preferred embodiment the thermosetting resin has so many hollow glass beads per $cm^3$ that a total density of approximately 0.5–0.8 kg/l is achieved therewith. Conventional thermosetting resins have a specific gravity of 1 to 1.5 kg/l, so that a considerable weight saving can be achieved with this measure. This means that less attention need be paid to the quantity of material used, which allows greater freedom for the shape of the body. The body can consequently be made a conventional shape in which the volume is 3 to 51 and the front surface is approximately 0.1 $m^2$, with all the advantages which this gives, without the total weight being unnecessarily high.

The invention also provides a method for the production of a neck connection for a stringed instrument of the type mentioned in the preamble, characterized in that it comprises the following steps:

a. applying a release agent to a mould;

b. putting in the desired number of fibre structures;

c. placing the core in the desired position;

d. putting in the desired numbers of side fibre structures, making use of the core as the positioning means;

e. closing the mould;

f. connecting the mould to an injection pump;

g. injecting moulding compound into the mould;

h. allowing the moulding compound to harden;

i. releasing the mould.

Being able to make a neck connection in one piece in this way considerably reduces the production costs, since two separate parts (the body and the neck) no longer need to be fixed to each other.

A gel coat can be applied to the mould with a brush or an airless spray gun between the above-mentioned steps a. and b.

Steps b. and c. can also be transposed.

The invention will be explained with reference to a FIGURE, which gives a diagrammatic view of a stringed instrument according to the invention, partially showing the internal structure thereof.

In the FIGURE reference number 1 indicates the body of a stringed instrument, for example an electric guitar. The shape illustrated is shown only by way of example. Any other shape is possible, while the body shown can also be designed for other stringed instruments, such as a violin. The body 1 and the neck 2 of the stringed instrument are in one piece.

Inside the body is a core 6, which fulfils various functions. First, the core 6 provides a cavity in the moulded product of the body 1, by means of which the sound of the body 1 can be adapted. Secondly, the core 6 provides a support or a positioning means for fibre structures 31–33, 41–43, 51–53 which will be discussed further below. Thirdly, the core 6 provides a space for electronics for the electronic stringed instrument, which stringed instrument, if the core wall is made of a metal which remains present in the product, is also situated in a Faraday cage in order to give protection from interfering radiation. Finally, the total weight of the body can be adapted by means of the core.

On account of the filling pressure of on average $1.5\times10^5$ Pa which occurs, the core must be compression-resistant. However, the core must not be too rigid or expand so greatly that rapid temperature changes produce stresses in the moulded product as a result of the exothermic reaction of the moulding resin. These conditions are met by, for example, a core made of aluminium of deep-drawing quality. During the moulding process such an aluminium box, filled with glass pearls in order to absorb the pressure of the moulding compound, is situated in a mould (not shown) in which the stringed instrument is formed.

As already said, the core 6 is used, inter alia, for giving support to fibre structures 31–33, 41–43, 51–53, the function of which will now be explained. The fibre structures preferably consist of fibre bands, i.e. of fibres woven to the form of bands, which are preferably carbon fibres. However, it is also possible to use loose fibres which are placed in the correct position in the correct thickness and length. These fibres may be "spun", possibly mechanically, in the mould during the production process. For the sake of convenience, the term "fibre bands" will always be used below, because such bands are preferred, but the invention is by no means restricted to the use of band-shaped fibre structures.

The fibre structures 31–33, 41–43, 51–53, impregnated with laminating resin and placed around the core 6, are preferably positioned as shown in the FIGURE. In the construction shown in the FIGURE three fibre bands 41–43 lie against the underside of the core 6. At the left side of the FIGURE the three fibre bands 41–43 project partially beyond the core 6. At the top right side of the FIGURE the fibre bands 41–43 also project beyond the core 6, but over a much greater distance, namely on into the neck 2 of the stringed instrument. Just to the right of the core 6 the fibre bands 41–43 are preferably curved in shape. Excellent accessibility of the highest positions of the neck are achieved by this, while the pick-up element can be placed very close up against the neck.

First side fibre bands 31–33 are shown in the FIGURE at the rear side of the core 6, projecting slightly beyond the core at the left side. At the right side of the core 6 the first side fibre bands 31–33 curve slightly towards the centre of the core 6, and then extend through a further bend on into the neck 2 of the stringed instrument. The flat side of the side fibre bands 31–33 is positioned substantially at right angles to the flat side of the bands 41–43.

Finally, the second side fibre bands 51–53 are situated at the front side of the FIGURE and are preferably of the same shape and structure as the first side fibre bands 31–33, albeit mirror-inverted relative to a plane parallel to the first side fibre bands 41–43 and through the centre of the core 6. A design advantage of the three groups of fibre bands is that the fibres 31–33; 41–43; 51–53 together form a three-point fastening from the neck to the body, so that the neck seems to "take root" in the less strong moulding resin, and the forces are transmitted in the optimum manner to the resonating body.

The fibres of the various fibre bands 31–33, 41–43, 51–53 can be made of different materials. They need only meet the requirement that they adhere to the resin types used for the laminating resin and the moulding resin and produce sufficient rigidity. The fibres must also have a high resistance to deformation (high modulus of elasticity), and the resistance to creep must be as great as possible. A preferred embodiment has unidirectional carbon fibres. For a plastic guitar the fibre bands can be, for example, 25 mm wide. The width of the fibre bands need not be the same over the full length of the bands. The rigidity of the neck connection can be adjusted separately from place to place by varying the width of the bands along the length. In other words, the total section of the fibres can be adapted to the force influence expected at each point in the neck.

The desired rigidity per zone can also be adapted by selecting a length A of the fibre bands 31, 41, 51 which is different from length B of the fibre bands 32, 42, 52 and from the length C of the fibre bands 33, 43, 53. The FIGURE shows that over the length A, B and C respectively the total number of bands at the underside and the two side edges is always 1, 2 and 3 respectively. However, these numbers can also be selected differently, deperding on the required rigidity of the body 1, the neck 2 and the transition from the body 1 to the neck 2. The following numbers in conjunction with a hardwood or other rigid finger-board gave good test results: over the length A: 1 bottom fibre band 41, 1 side fibre band 31 and 1 side fibre band 51; over the length B: 2 bottom fibre bands 41/42, 2 side fibre bands 31/32 and 2 side fibre bands 51/52; over the length C: 4 bottom fibre bands 41/42/43 (the fibre band 43 is then made double) and 3 side fibre bands 31/32/33 and 3 side fibre bands 51/52/53. Of course, it is also possible to make the various fibre bands of different thicknesses, with the result that the rigidity can be varied from place to place. It is even possible to vary the thickness of a fibre band along its length, in order to bring the rigidity up to the desired value. If loose fibres are used instead of fibre bands, such a 'tapered' structure can, of course, be obtained by placing more or fewer of such fibres in the correct places.

In order to make the total weight of the neck connection as low as possible, a plastic filled with hollow glass beads, which is preferably a thermosetting resin, is used as the moulding compound. For the hollow glass beads it is possible in this case to use 3M glass bubbles with, for example, a nominal diameter of 50 to 70 $\mu$m and a wall thickness of 1 to 3 $\mu$m. Suitable thermosetting resins are, for example: UP (unsaturated polyester), PU (polyurethane), EP (epoxy) or vinyl ester with MEKP hardener. These resin types are suitable both for the laminating resin of the fibre bands 31, 32, 33; 41, 42, 43; 51, 52, 53 and for the moulding resin. Other resin types are also conceivable. Through a suitable choice of numbers of beads per $cm^2$, it is thus possible to achieve a low density of 0.5 –0.8 kg/l.

Low-pressure injection technology is a good choice for the original shaping (moulding) with glass beads. The pressure does not have to be very high, for the beads can easily slide over one another, so that a moulding compound with better moulding and filling properties is produced. The only reason for pressure being used is the very low weight. Without pressure, i.e. by force of gravity, it takes too long for a mould to be filled.

In order to produce a stringed instrument with a neck connection in one piece, the following method steps are carried out:

a. applying a release agent to a mould (not shown);

b. putting in the desired number of bottom fibre bands 41, 42, 43;

c. placing a core 6 in the desired position;

d. putting in the desired numbers of side fibre bands 31, 32, 33 and 51, 52, 53 respectively, making use of the core 6 as the positioning means;

e. closing the mould;

f. connecting the mould to an injection pump (not shown);

g. injecting the moulding compound into the mould;

h. allowing the moulding compound to harden;

i. releasing the mould.

In principle, the stringed instrument is then ready for further finishing. The core 6 is placed in such a way that, after hardening, it projects slightly from the neck connection, so that it can be opened. The glass beads situated therein are then removed, following which the core 6 is suitable for the accommodation of, for example, electronics. The core 6 is also so much higher than the width of the side fibre bands 31, 32, 33, 51, 52, 53 that there is sufficient room in the mould for the moulding compound to be able to run along the core 6 and along the side fibre bands 31, 32, 33, 51, 52, 53 into the space behind the core 6 near the neck 2. The fibre bands 41, 42, 43 are also narrower than the width of the core 6, so that moulding compound can also flow through below the core 6 in the direction of the neck 2.

If desired, a gel coat can also be applied to the mould with a brush or an airless spray gun between the above-mentioned steps (a) and (b). As an alternative to the method described, steps (b) and (c) can also be transposed, so that the fibre bands 41, 42, 43 are situated against the top side of the core 6. The mould must then be formed in such a way that, after hardening, the core projects from the neck connection at the underside.

I claim:

1. A stringed instrument, comprising at least a body and a neck both the neck and the body being made of plastic, wherein the body (1) and the neck (2) are in one piece and the neck connection comprises at least bottom fibre structures (41, 42, 43) and side fibre structures (31, 32, 33; 51, 52, 53) moulded into the plastic, which fibre structures (41, 42, 43) and side fibre structures (31, 32, 33; 51, 52, 53) extend both in the neck (2) and in the body (1), whereby the neck is rooted in the body by said fibre structures.

2. An instrument according to claim 1, wherein the bottom strutures (41, 42, 43) and side fibre structures (31, 32, 33; 51, 52, 53) are in the form of a band.

3. An instrument according to claim 1, wherein a core (6) is also placed in the body (1).

4. An instrument according to one of claim 3, wherein the fibre structures (41, 42, 43) and the side fibre structures (31, 32, 33; 51, 52, 53) rest against the core (6) and are positioned by it in the body (1).

5. An instrument according to claim 2, wherein the plane of the band-shaped fibre structures (41, 42, 43) is substantially at right angles to the plane of the band-shaped side fibre structures (31, 32, 33; 51, 52, 53).

6. An instrument according to claim 1, wherein the fibre structures (41, 42, 43) comprise four bands placed on top of one another, and the side fibre structures (31, 32, 33; 51, 52, 53) comprise two band parts (31, 32, 33; and 51, 52, 53) respectively running largely parallel, each of which band parts consists of three bands placed on top of one another.

7. An instrument according to claim 5, wherein the fibre structures (41, 42, 43) and side fibre structures (31, 32, 33; 51, 52, 53) comprise at least one band (31, 41 and 51 respectively) of a first length (A), at least one band (32, 42 and 52 respectively of a second length (B), and at least one band (33, 43 and 53 respectively) of a third length (C), the first, second and third lengths not being equal to one another.

8. An instrument according to claim 2, wherein the bands of the fibre structures (41, 42, 43) and the side fibre structures (31, 32, 33; 51, 52, 53) are of equal width and thickness over their entire length.

9. An instrument according to claim 2, wherein the bands of the fibre structures (41, 42, 43) and the side fibre structures (31, 32, 33; 51, 52, 53) have a width of approximately 25 mm over their length.

10. An instrument according to claim 1, wherein the fibre structures (41, 42, 43) and the side fibre structures (31, 32, 33; 51, 52, 53) are made of a unidirectional carbon fibre embedded in a laminating resin.

11. An instrument according to claim 1, wherein the plastic consists of thermosetting resin filled with hollow glass beads.

12. An instrument according to claim 11, wherein the thermosetting resin has so many hollow glass beads per $cm^3$ that a total density of approximately 0.5–0.8 kg/l is achieved therewith.

13. Method for the production of a stringed instrument, which comprises the following steps:

a. applying a release agent to a mould;

b. putting in the desired number of bottom fibre structures (41, 42, 43), embedded in a laminating resin;

c. placing a core (6) in the desired position;

d. putting in the desired numbers of side fibre structures (31, 32, 33 and 51, 52, 53 respectively) embedded in a laminating resin, making use of the core (6) as the positioning means;

e. closing the mould;

f. connecting the mould to an injection pump;

g. injecting moulding compound into the mould;

h. allowing the moulding compound to harden;

i. releasing the mould.

14. Method according to claim 13, wherein a gel coat is applied to the mould with a brush or an airless spray gun between steps a. and b.

15. Method according to claim 13, wherein steps b. and c. are transposed.

* * * * *